United States Patent [19]

Johansson et al.

[11] 4,347,941

[45] Sep. 7, 1982

[54] PALLET COLLAR

[75] Inventors: Sigvard Johansson, Gränna; Wells R. S. Pearson, Gnosjö, both of Sweden

[73] Assignee: Gnosjöplast Aktiebolag, Gnosjö, Sweden

[21] Appl. No.: 244,773

[22] Filed: Mar. 17, 1981

Related U.S. Application Data

[63] Continuation of Ser. No. 77,100, Sep. 10, 1979, abandoned.

[30] Foreign Application Priority Data

Sep. 8, 1978 [SE] Sweden ..... 7809452

[51] Int. Cl.[3] ..... B65D 19/10

[52] U.S. Cl. ..... 220/6; 220/4 F; 220/1.5; 217/43 A

[58] Field of Search ..... 220/6, 1.5, 4 F, 72, 220/83; 217/43 A

[56] References Cited

U.S. PATENT DOCUMENTS

| | | | |
|---|---|---|---|
| 2,525,838 | 10/1950 | Smith et al. | 220/6 X |
| 2,901,141 | 8/1959 | Dedmon | 217/43 A |
| 3,064,845 | 11/1962 | Maxwell | 217/43 A |
| 3,119,508 | 1/1964 | Wallace | 220/6 |
| 3,987,829 | 10/1976 | Leone | 220/72 X |
| 4,002,261 | 1/1977 | Litchfield | 220/83 X |
| 4,174,046 | 11/1979 | Atkins | 220/6 |

FOREIGN PATENT DOCUMENTS

| | | |
|---|---|---|
| D. 18889 | 6/1976 | Sweden . |
| D. 18928 | 6/1976 | Sweden . |

*Primary Examiner*—Steven M. Pollard

*Attorney, Agent, or Firm*—Cushman, Darby & Cushman

[57] ABSTRACT

A pallet collar comprises four walls which are hingedly interconnected by means of hinges, so that the pallet collar may be collapsed or folded up into a substantially flat condition. To increase the utility and versatility of the pallet collar at least one pair of opposite walls are provided with supporting ribs on their inside, which extend substantially parallel to the bottom edge of the respective wall, somewhat above said bottom edge and are intended to carry a removable bottom in cooperation with the supporting rib of the opposite wall. Thanks to these supporting ribs it is possible to convert the pallet collar into a form-stable, open case by placing the bottom upon the ribs.

Each supporting rib may be divided into a plurality of individual portions which are separated from each other by interspaces in such a manner that the supporting rib portions of two adjacent walls become located just opposite interspaces between adjacent supporting rib portions of the other walls, when the pallet collar is folded up or collapsed into a substantially flat condition.

1 Claim, 3 Drawing Figures

PALLET COLLAR

This is a continuation of application Ser. No. 74,100 filed Sept. 10, 1979, now abandoned.

BACKGROUND OF THE INVENTION

This invention relates to a pallet collar of the type comprising two pairs of walls which are interconnected by means of hinges. Pallet collars of the same general kind form the subject matter of the Swedish Design Registrations 18 889 and 18 928.

SUMMARY OF THE INVENTION

The principal object of the invention is to provide a pallet collar of this type which easily may be supplemented with a removable bottom and thereby be converted to a form-stable, open case.

This object is attained thanks to the fact that each one of at least one pair of mutually opposite walls on its inside is provided with a supporting rib which extends substantially parallel to the bottom edge of the respective wall, somewhat above said bottom edge, for carrying a removable bottom in cooperation with the supporting rib of the opposite wall.

BRIEF DESCRIPTION OF THE DRAWINGS

Further features and advantages of the pallet collar according to the invention will become apparent from the following detailed description and the annexed drawings which diagrammatically and as non-limiting examples illustrate a preferred embodiment of the invention, and in which.

DESCRIPTION OF THE PREFERRED EMBODIMENT

Figure 1:
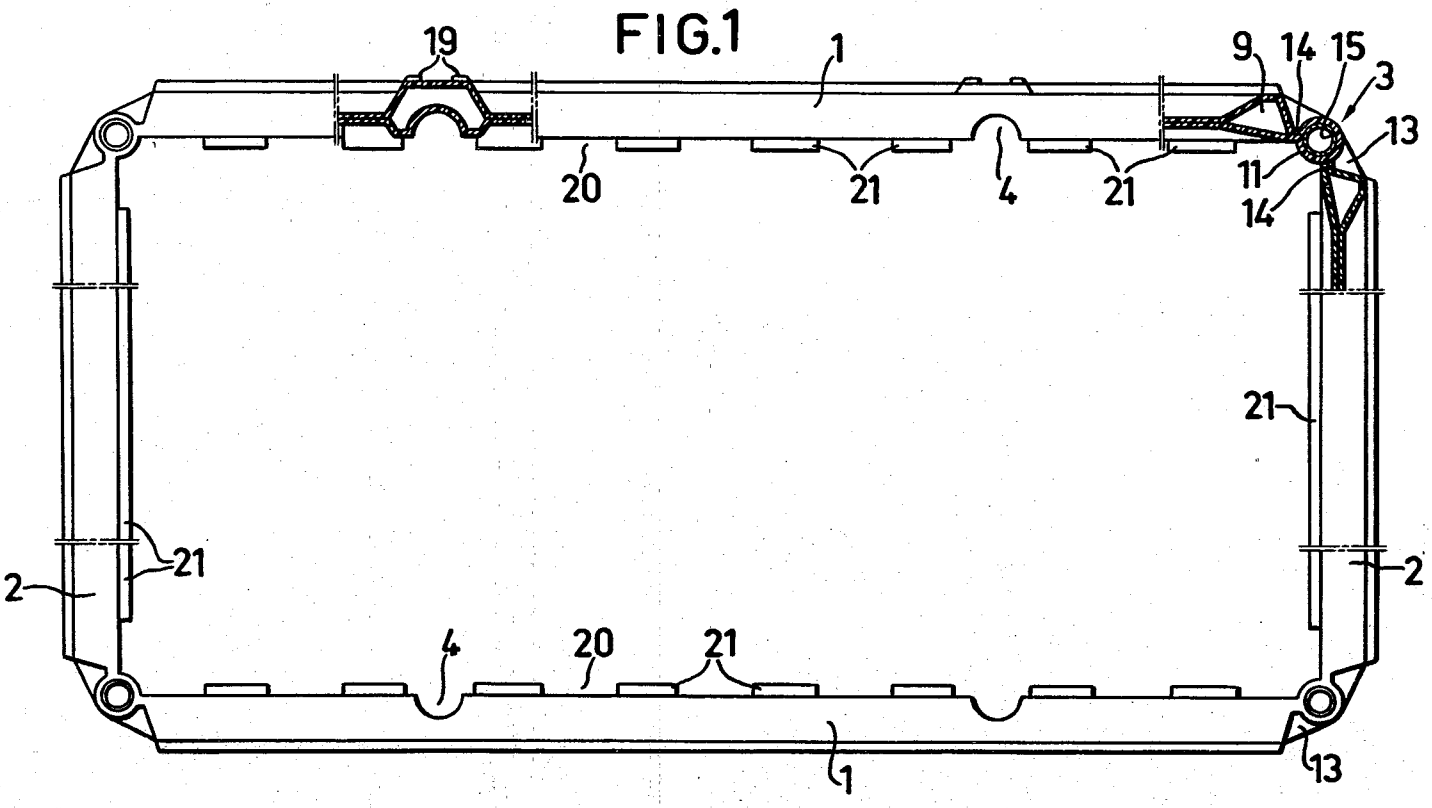
FIG. 1 is partially sectional plan view of a pallet collar according to the invention.

The pallet collar according to the invention comprises four walls, viz. two longitudinal walls 1 and two end walls 2. Adjacent longitudinal walls and end walls, respectively, are hingedly interconnected by means of hinges 3, so that the pallet collar may be collapsed or folded up into a substantially flat condition in a manner known per se. To permit the insides of the walls 1, 2, which face each other after the folding-up operation, to get close together, the longitudinal walls 1 are provided with a pair of vertical recesses or grooves 4, which have a substantially semi-circular cross section and are so located that one of the hinges penetrates into one recess 4 of the opposite longitudinal wall 1 at the folding-up of the pallet collar.

Figure 3:
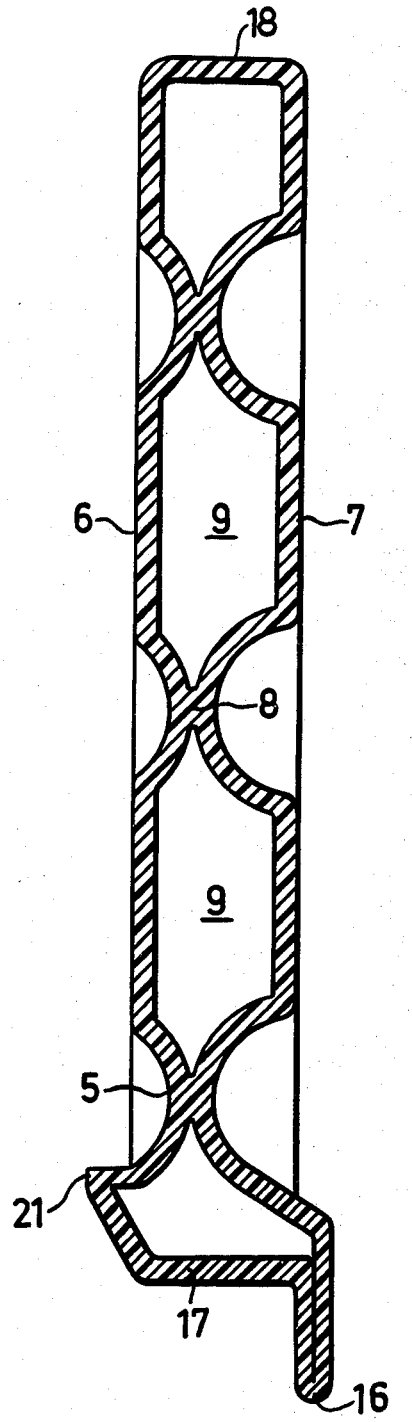
FIG. 3 is a sectional view substantially on line III—III in FIG. 2.

In the exemplificatory embodiment illustrated in the drawings the walls 1, 2 are comprised of substantially or at least partly hollow shells and are preferably manufactured by technical blow-molding of a suitable thermosetting resin or another suitable plastic. As is most clearly shown in FIG. 3 each wall comprises narrower or pressed-in areas or domains 5 within which the inner shell wall 6 and the outer shell wall 7 are pressed together and united with each other as shown at 8. From FIG. 3 it is also apparent, that the pressed-in areas are deeper on the outside of the wall than on its inside, but this is not obligatory. The pressed-in or compressed areas 5 are separated or isolated from each other by hollow portions or spaces 9 which fill up the remainder of the respective wall and communicate with each other for manufactural-technical reasons.

At their vertical end edges the walls 1, 2 are terminated by tubular hinge members. In the exemplificatory embodiment each longitudinal wall 1 has two tubular hinge members 11, and each end wall has one tubular hinge member 12. In lieu hereof each wall 1, 2 may within the scope of the invention have two hinge members 11 at its one (e.g. right-hand) end and one hinge member 12 at its other (e.g. left-hand) end. The hinge members, which become closed at their ends at the form-blowing operation and thus are hollow, are united with their respective wall partly by an equally hollow reinforcing rib 13, which connects the hollow hinge member 11, 12 with the inner space of the respective wall 1, 2, partly by compressed shell wall portions 14 which extend along those generatrixes of the tubular hinge members 11, 12 which face the respective wall 1, 2, as is most clearly apparent from FIG. 2 and the upper, right-hand corner of FIG. 1 which is comprised of a horizontal section.

Figure 2:
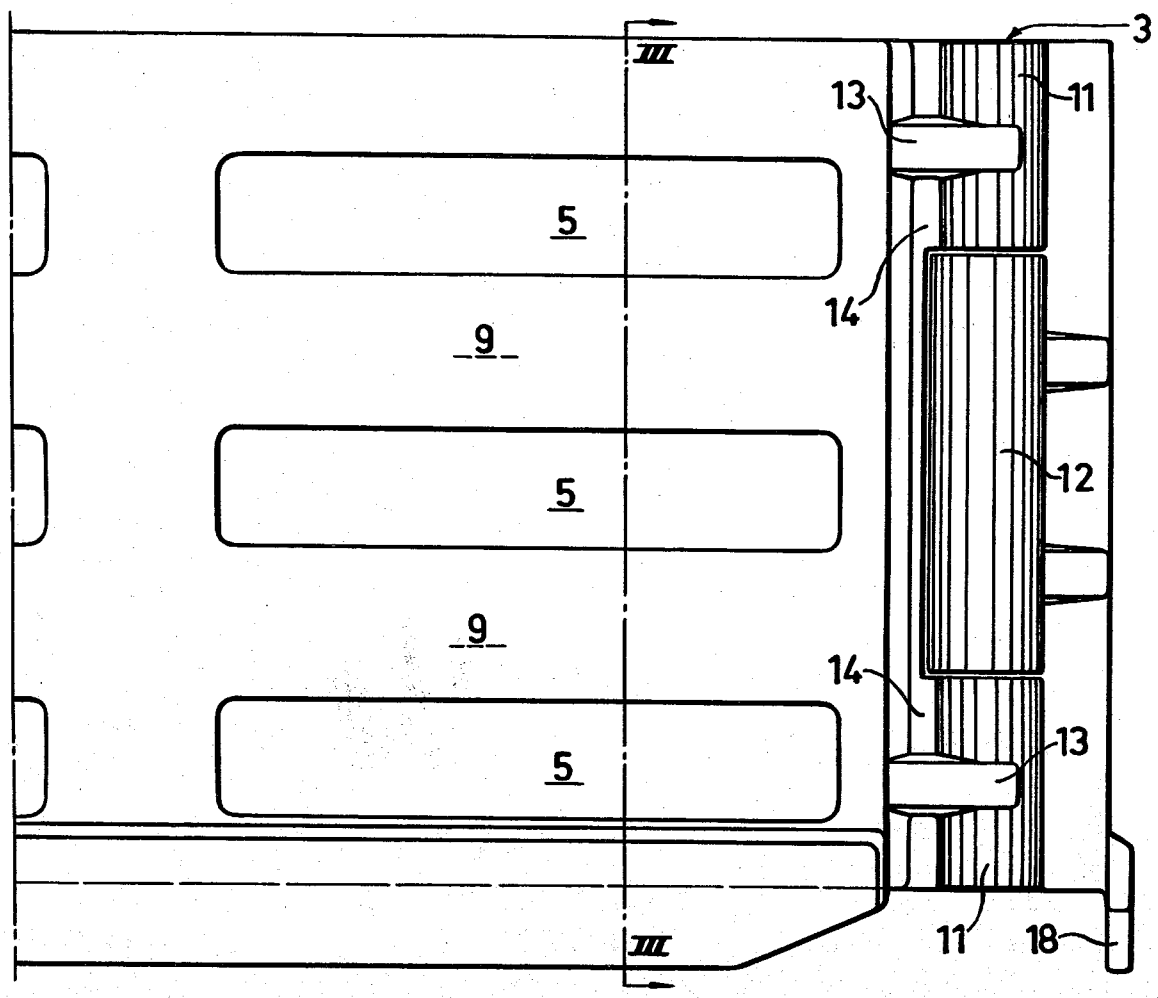
FIG. 2 is a side view of one corner of the pallet collar.

To complete the hinged connections between the walls 1 and 2 one first removes the closed ends of the hinge members 11, 12, which are subsequently adjusted pairwise into a mutually coaxial position, after which a hinge bolt or spindle 15, which extends along the entire height of the walls 1, 2, is introduced into the hinge members 11, 12. The spindle 15 which may be tubular, as shown in FIG. 1, or solid is preferably so sturdily dimensioned that, at the stacking of pallet collars upon each other, it can carry at least the major portion of the weight of all pallet collars which are supported by the lowermost pallet collar. When the hinge spindles are tubes as shown at least their lowermost ends are somewhat flared to hereby increase the support surface and the stability at stacking. The hinges are preferably so designed that one does not risk to pinch one's fingers between the ends of the walls 1,2 at the following up of the pallet collar.

The bottom edge of the walls 1, 2 forms a support surface 17 which has substantially the same external measures as a pallet deck of the standard size. To center the pallet collar on a pallet deck the walls 1, 2 have guide flanges 16 which extend along the outer edges of the support surfaces 17 and project downwards below the same and grip the edges of the pallet deck when the pallet collar is placed thereupon. In the same way the top edge of the walls 1, 2 constitutes a support surface 18 which corresponds to the support surface 17 and is substantially congruent therewith and upon which another, more elevated pallet is intended to rest with its support surface 17 at the stacking of pallet collars upon each other.

Two or more pallet collars may be united into a pallet collar of a correspondingly greater height by introducing studs or rods, preferably of the same height as the composite pallet collar, into the tubular hinge spindles 15. The individual collars of the composite pallet collar thus formed may be held together e.g. by the friction engagement between the rods and the tubular spindles 15.

To prevent collapsed pallet collars stacked upon each other from mutual sliding at least the longitudinal walls 1, and possibly also the end walls 2, may be provided with intended or serrated areas, which preferably extend like stripes over the entire height dimension of the pallet collar. Such indentations or serrations are indicated only on one long wall 1 in FIG. 1 at 18. The serrated areas are suitably checkered or gaufred in such a way that at straight stacking of collapsed pallet collars upon each other the raised portions or crests of a serrated area of one pallet collar will become located just opposite, and engage into, the recesses of a serrated area of an adjacent pallet collar.

According to the invention at least the longitudinal walls 1 and preferably also the end walls 2 are internally provided with supporting ribs which are located somewhat above the bottom edge of the respective collar wall. These supporting ribs which are generally designated with 21 are intended to carry a removable bottom (not shown) by means of which the pallet collar may be converted to a form-stable open case. The supporting ribs may be continous in their entire length, as shown in respect of the end walls 2, or alternatively be divided into individual portions, isolated from each other by interspaces 20, as is shown in respect of the longitudinal walls 1. As is apparent from FIG. 3 the support ribs and the support rib portions 21 are hollow substantially in their entire length and communicate with the hollow spaces 9 of the appurtenant wall.

These rib portions 21 and interspaces 20 are preferably so arranged and located that at the folding-up or collapsing of the pallet collar into a substantially flat condition the rib portions of one wall or two adjacent walls will become located just opposite to, and engage into, the interspaces 20 between the supporting rib portions 21 of the opposite wall or walls. Within these interspaces the walls 1, 2 may on their inside be provided with grooves or recesses for receiving the supporting rib portions 21 of the opposite walls, whereby the pallet collar may be made still flatter at collapsing, since the walls 1, 2 will then become substantially parallel to each other.

The embodiment described above and illustrated in the drawings is, of course, to be regarded merely as a nonlimiting example and may as to its details be modified in several ways within the scope of the following claims. Thus, plane or alternatively two or three-dimensionally curved, alternatingly hollow and solid plate elements, which in principle correspond to the walls 1, 2, may be utilized for other purposes than pallet collars.

What we claim is:

1. A pallet collar comprising two pairs of substantially rigid plastic walls each having opposite ends and hinges at said opposite ends, said walls being interconnected by means of said hinges only at said respective ends, each wall having a bottom edge forming a support surface for engagement with the upper surface of the peripheral edge of a pallet to thereby support the pallet collar upon the pallet, and an external flange projecting downwards from the outer peripheral edge of said bottom edge for engaging the outer circumference of the peripheral edge of the pallet, each one of at least one pair of mutually opposite walls being provided on its inside with an integral internal supporting rib which extends substantially parallel to said bottom edge of the respective wall along at least a major portion of said wall above said support surface for carrying a removable bottom in cooperation with the supporting rib of the opposite wall, each of said internal supporting ribs extending in the same plane as the supporting rib of the other wall in the folded out working position of the pallet collar, each supporting rib being divided into a plurality of individual portions which are separated from each other by interspaces, each supporting rib of a pair of adjacent walls being located just opposite an interspace between two supporting rib portions of the remaining pair of adjacent collar walls when the pallet collar is folded into a collapsed, substantially flat condition.

* * * * *